US008100523B2

(12) United States Patent
Spence et al.

(10) Patent No.: US 8,100,523 B2
(45) Date of Patent: Jan. 24, 2012

(54) BIDIRECTIONAL MEDIA SHEET TRANSPORT APPARATUS

(75) Inventors: James J. Spence, Honeoye Falls, NY (US); Mark S. Amico, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 1161 days.

(21) Appl. No.: 11/642,028

(22) Filed: Dec. 19, 2006

(65) Prior Publication Data

US 2008/0143043 A1 Jun. 19, 2008

(51) Int. Cl.
*B65H 9/00* (2006.01)

(52) U.S. Cl. ..... 347/104; 271/225

(58) Field of Classification Search ..... 347/104; 271/225

See application file for complete search history.

(56) References Cited

U.S. PATENT DOCUMENTS

| | | | |
|---|---|---|---|
| 3,856,461 | A | 12/1974 | Jordan |
| 4,378,152 | A | 3/1983 | Edwards et al. |
| 4,572,648 | A | 2/1986 | Toriumi et al. |
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,008,713 | A | 4/1991 | Ozawa et al. |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,219,159 | A | 6/1993 | Malachowski et al. |
| 5,241,348 | A | 8/1993 | Garavuso et al. |
| 5,272,511 | A | 12/1993 | Conrad et al. |
| 5,326,093 | A | 7/1994 | Sollitt |
| 5,327,204 | A | 7/1994 | Sculley et al. |
| 5,350,896 | A | 9/1994 | Amico et al. |
| 5,353,107 | A | 10/1994 | Sculley et al. |
| 5,435,544 | A | 7/1995 | Mandel |
| 5,473,419 | A | 12/1995 | Russel et al. |
| 5,475,200 | A | 12/1995 | Amico et al. |
| 5,489,969 | A | 2/1996 | Soler et al. |
| 5,497,218 | A | 3/1996 | Amico |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,600,418 | A | 2/1997 | Hart et al. |
| 5,613,178 | A | 3/1997 | Amico |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner* — Matthew Luu
*Assistant Examiner* — Rut Patel
(74) *Attorney, Agent, or Firm* — Fay Sharpe LLP

(57) ABSTRACT

Disclosed is a bidirectional media sheet transport apparatus. The transport apparatus includes one or more belt driven bidirectional nip assemblies aligned to transport one or more media sheets along a bidirectional path. In addition, disclosed are belt tensioning devices to apply multiple tension forces to a belt operatively engaging the one or more bidirectional nip assemblies. Also disclosed is a bidirectional baffle apparatus to enable bidirectional travel of a media sheet from one module to another module.

12 Claims, 7 Drawing Sheets

U.S. PATENT DOCUMENTS 5,629,762 A 5/1997 Mahoney et al.
5,666,593 A 9/1997 Amico
5,710,968 A 1/1998 Clark et al.
5,778,377 A 7/1998 Marlin et al.
5,835,829 A 11/1998 Genovese et al.
5,884,910 A 3/1999 Mandel
5,995,721 A 11/1999 Rourke et al.
6,059,284 A 5/2000 Wolf et al.
6,125,248 A 9/2000 Moser
6,175,715 B1 * 1/2001 Hirao et al. ..... 399/384
6,198,902 B1 3/2001 Vaughan et al.
6,241,242 B1 6/2001 Munro
6,246,858 B1 6/2001 Condello et al.
6,263,181 B1 7/2001 Vaughan et al.
6,297,886 B1 10/2001 Cornell
6,341,773 B1 1/2002 Aprato et al.
6,384,918 B1 5/2002 Hubble, III et al.
6,395,444 B1 5/2002 Riehle et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,663,099 B2 * 12/2003 Inoue ..... 271/162
6,733,110 B1 * 5/2004 Pinkernell et al. ..... 347/40
6,736,394 B2 5/2004 Herrmann et al.
6,782,233 B2 8/2004 Condello et al.
6,816,269 B1 11/2004 Loce et al.
6,817,609 B2 11/2004 Halvonik et al.
6,819,906 B1 11/2004 Herrmann et al.
6,856,785 B1 2/2005 Schwenk et al.
6,866,260 B2 3/2005 Williams et al.
6,909,516 B1 6/2005 Hoover
6,925,283 B1 8/2005 Mandel et al.
6,959,165 B2 10/2005 Mandel et al.
6,973,286 B2 12/2005 Mandel et al.
6,974,128 B2 12/2005 Quesnel
7,013,107 B2 3/2006 Russel et al.
7,024,152 B2 4/2006 Lofthus et al.
7,039,348 B2 5/2006 Kerxhalli et al.
7,046,948 B1 5/2006 Zess et al.
7,108,260 B2 * 9/2006 Biegelsen et al. ..... 271/303
7,123,873 B2 10/2006 deJong et al.
7,139,629 B2 * 11/2006 Fromherz et al. ..... 700/100
7,918,453 B2 * 4/2011 Duff et al. ..... 271/272
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2005/0048294 A1 3/2005 Kaplan et al.
2005/0135846 A1 6/2005 Russel et al.
2006/0033771 A1 2/2006 Lofthus
2006/0066885 A1 3/2006 Anderson et al.
2006/0067756 A1 3/2006 Anderson et al.
2006/0067757 A1 3/2006 Anderson et al.
2006/0114313 A1 * 6/2006 Moore ..... 347/262
2006/0114497 A1 6/2006 Anderson et al.
2006/0115284 A1 6/2006 Grace et al.
2006/0115287 A1 6/2006 Roof
2006/0115288 A1 6/2006 Roof
2006/0132815 A1 6/2006 Lofthus et al.
2006/0176336 A1 8/2006 Moore et al.
2006/0193661 A1 8/2006 Zess et al.
2006/0197966 A1 9/2006 Viturro et al.
2006/0209101 A1 9/2006 Mizes
2006/0214359 A1 9/2006 Clark
2006/0214364 A1 9/2006 Clark et al.
2006/0215240 A1 9/2006 Mongeon
2006/0221159 A1 10/2006 Moore et al.
2006/0221362 A1 10/2006 Julien
2006/0222378 A1 10/2006 Julien
2006/0222384 A1 10/2006 Moore et al.
2006/0222393 A1 10/2006 de Jong et al.
2006/0227350 A1 10/2006 Crawford et al.
2006/0230201 A1 10/2006 Fromherz et al.
2006/0230403 A1 10/2006 Crawford et al.
2006/0233569 A1 10/2006 Furst et al.
2006/0235547 A1 10/2006 Hindi et al.
2006/0238778 A1 10/2006 Mongeon et al.
2006/0244980 A1 11/2006 Grace

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.
U.S. Appl. No. 11/109,566, filed Apr. 19, 2005, Mandel et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.

U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.
U.S. Appl. No. 11/417,411, filed May 4, 2006, DeGruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.
U.S. Appl. No. 11/487,206, filed Jul. 14, 2006, Wu et al.
U.S. Appl. No. 11/485,870, filed Jul. 13, 2006, Moore.
U.S. Appl. No. 11/474,247, filed Jun. 23, 2006, Moore.
U.S. Appl. No. 11/483,747, filed Jul. 6, 2006, Meetze.
U.S. Appl. No. 11/495,017, filed Jul. 28, 2006, Bean.
U.S. Appl. No. 11/501,654, filed Aug. 9, 2006, Mestha et al.
U.S. Appl. No. 11/522,171, filed Sep. 15, 2006, Sampath et al.
U.S. Appl. No. 11/528,770, filed Sep. 27, 2006, Degruchy.
U.S. Appl. No. 11/545,176, filed Oct. 10, 2006, deJong et al.

* cited by examiner

BIDIRECTIONAL MEDIA SHEET TRANSPORT APPARATUS

CROSS REFERENCE TO RELATED PATENTS AND APPLICATIONS

The following patents/applications, the disclosures of each being totally incorporated herein by reference are mentioned.

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Pat. No. 7,123,873, issued Oct. 17, 2006, entitled "PRINTING SYSTEM WITH INVERTER DISPOSED FOR MEDIA VELOCITY BUFFERING AND REGISTRATION," by Joannes N. M. deJong, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. Publication No. US-2006-0214364-A1, Published Sep. 28, 2006, entitled "SHEET REGISTRATION WITHIN A MEDIA INVERTER," by Robert A. Clark, et al.;

U.S. Publication No. US-2006-0214359-A1, Published Sep. 28, 2006, entitled "INVERTER WITH RETURN/BYPASS PAPER PATH," by Robert A. Clark;

U.S. Publication No. US-2006-0222378-A1, Published Oct. 5, 2006, entitled "PRINTING SYSTEM," by Paul C. Julien;

U.S. Publication No. US-2006-0221159-A1, Published Oct. 5, 2006, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/331,627, filed Jan. 13, 2006, entitled "PRINTING SYSTEM INVERTER APPARATUS", by Steven R. Moore;

U.S. application Ser. No. 11/349,828, filed Feb. 8, 2005, entitled "MULTI-DEVELOPMENT SYSTEM PRINT ENGINE", by Martin E. Banton; and U.S. application Ser. No. 11/359,065, filed Feb. 22, 2005, entitled "MULTI-MARKING ENGINE PRINTING PLATFORM", by Martin E. Banton.

BACKGROUND

This disclosure relates to a media sheet transport apparatus. Specifically, this disclosure relates to a bidirectional print media sheet transport for use in a printing system.

Conventionally, printing systems include media sheet transports which route media sheets such as cut sheet paper from a sheet feeder to one or more marking engines for marking the media sheets with text and/or an image. Subsequent to the image marking engine marking the media sheet, the marked media sheet is routed through a fuser for further fixing of the toner to the media sheet. From the fuser, the marked media sheet may be routed to one or more other marking engines or routed to a finisher module which further processes the marked media sheet and possibly stacks the finished sheets.

To accommodate transportation of media sheets from the sheet feeder to one or more marking engines or other printing apparatuses, a media sheet transportation system is integrated within the printing system. Conventionally this media sheet transportation system includes a series of integrated nip assemblies. The nip assemblies include a top roller and bottom roller, where the media sheet passes between the rollers and one of the rollers is driven by a motor in a single direction. Notably, conventional printing systems include a unidirectional highway configuration to transport media sheets. To accomplish bidirectional media sheet travel within the printing system, multiple media sheet highways are integrated where a first series of nip assemblies provides media sheet travel in a first direction and a second series of nip assemblies provides media sheet travel in a second direction.

This disclosure provides a bidirectional media sheet transport which includes bidirectional nip assemblies to transport a media sheet in two opposite directions.

BRIEF DESCRIPTION

In one aspect of this disclosure, a media sheet transport is disclosed. The media sheet transport comprises one or more nip assemblies aligned to transport a media sheet along a path; and a motor operatively connected to the one or more nip assemblies, wherein the media sheet transport is adapted to selectively transport a media sheet in a first direction along the path and transport a media sheet in a second direction along the path, wherein the second direction is opposite the first direction.

In another aspect of this disclosure, a media sheet transport is disclosed. The media sheet transport comprises a frame adapted to align the one or more nip assemblies.

In another aspect of this disclosure, a media sheet transport is disclosed. The media sheet transport comprises a belt operatively connected to one or more nip assemblies; a belt tension arm assembly operatively connected to a belt; and a motor shaft operatively connected to a motor and the belt tension arm assembly, wherein the motor drives the shaft, tension arm, belt and nip assemblies.

In another aspect of this disclosure, a media sheet transport is disclosed wherein a motor rotates in a first direction to transport one or more media sheets in a first direction and the motor rotates in a second direction to transport one or more media sheets in a second direction.

In another aspect of this disclosure, a media sheet transport is disclosed wherein a belt tension arm assembly exerts a first force on a belt while a motor rotates in a first direction and the tension arm assembly applies a second force on the belt while the motor rotates in a second direction, where the first and second forces are not equivalent vectors.

In another aspect of this disclosure, a media sheet transport is disclosed wherein a belt tension arm assembly comprises a first belt tension arm operatively connected to a motor shaft; and a second belt tension arm is operatively connected to the motor shaft, wherein the first belt tension arm applies the first force on the belt and the second belt tension arm exerts the second force on the belt.

In another aspect of this disclosure, a media sheet transport is disclosed which comprises a clutch operatively connected to a motor shaft and belt tension arm assembly, wherein the clutch controls a first and second force, applied to the belt.

In another aspect of this disclosure, a media sheet transport is disclosed wherein the media sheet transport comprises a first nip assembly comprising one or more nip roller pairs, wherein the nip roller pairs comprise a top roller and a bottom roller, and the bottom roller is operatively connected to be driven by a belt.

In another aspect of this disclosure, a media sheet transport is disclosed wherein the media sheet transport comprises a second nip assembly comprising one or more nip roller pairs, wherein the nip roller pairs comprise a top roller and a bottom roller, and the bottom roller is operatively connected to be driven by a belt.

In another aspect of this disclosure, a media sheet transport is disclosed which comprises one or more input/output baffles operatively connected to one or more nip assemblies wherein the input/output baffles are adapted to selectively provide an entrance and exit for a media sheet.

In another aspect of this disclosure, a media sheet transport is disclosed wherein input/output baffles comprise a baffle throat closed mode of operation to output a media sheet and a baffle throat open mode of operation to input a media sheet.

In another aspect of this disclosure, a media sheet transport is disclosed wherein input/output baffles comprise a top baffle member; and a bottom baffle member, wherein the top baffle member and bottom baffle member are substantially parallel during the baffle throat closed mode of operation and the top baffle member and bottom baffle member are opened an angle greater than zero degrees during the baffle throat open mode of operation.

In another aspect of this disclosure, a media sheet transport is disclosed wherein the input/output baffles comprise a first spring operatively connected to the top baffle member; and a second spring operatively connected to the bottom baffle member, wherein the first and second springs are operatively connected to one or more actuators, the one or more actuators providing the necessary force to open and close the input/output baffles.

In another aspect of this disclosure, a printing system is disclosed wherein the printing system comprises a printing module comprising an input/output baffle; and a bidirectional media sheet transport module comprising an input/output baffle operatively connected to the printing module input/output baffle and an output, wherein the printing module input/output baffle is closed and the bidirectional media sheet transport module input/output baffle is open while a media sheet is routed from the printing module input/output baffle to the bidirectional media sheet transport input/output baffle, and the printing module input/output baffle is open and the media sheet transport module input/output baffle is closed while a media sheet is routed from the printing module input/output baffle to the bidirectional media sheet transport module input/output baffle.

In another aspect of this disclosure, a printing system is disclosed. The printing system comprises a printing module comprising an image marking path comprising a media sheet input path and a media sheet output path; a bidirectional transport highway comprising a first input/output and a second input/output, wherein the first input/output is operatively connected to the printing module input path, and the second input/output is operatively connected to an input/output baffle, and the bidirectional media sheet transport module comprises a first transport highway operatively connected to the printing module media sheet output; and a second bidirectional transport highway operatively connected to the printing module input/output baffle and the bidirectional media sheet transport module output.

In another aspect of this disclosure, a printing system is disclosed wherein a printing module bidirectional transport highway selectively inverts a media sheet from a printing module image marking path.

In another aspect of this disclosure, a printing system is disclosed wherein a printing module bidirectional transport highway selectively routes a media sheet from a printing module image marking path to a printing module bidirectional transport highway second input/output.

In another aspect of this disclosure, a printing system is disclosed wherein the printing system comprises a media sheet feeder module operatively connected to a printing module image marking path; and a finisher module operatively connected to a bidirectional media sheet module output.

In another aspect of this disclosure, a xerographic machine is disclosed wherein the xerographic machine comprises an image marking input path; an image marking zone operatively connected to the image marking input path; an image marking output path operatively connected to the image marking zone; and a bidirectional media sheet transport operatively connected to the image marking input path, wherein the bidirectional media sheet transport is adapted to selectively invert a media sheet for subsequent image marking and selectively transport a media sheet from the image marking input path along an image marking bypass path.

In another aspect of this disclosure, a xerographic machine is disclosed wherein the xerographic machine comprises a bidirectional media sheet transport comprising one or more nip assemblies aligned to transport a media sheet along a image marking bypass path; and a motor operatively connected to the one or more nip assemblies, wherein the bidirectional media sheet transport is adapted to selectively transport a media sheet in a first direction along the bypass path and transport a media sheet in a second direction along the bypass path, wherein the second direction is opposite the first direction.

DETAILED DESCRIPTION

As briefly discussed in the background section of this disclosure, this disclosure provides a bidirectional media sheet transport for use in a printing device and/or printing system.

Figure 1A:
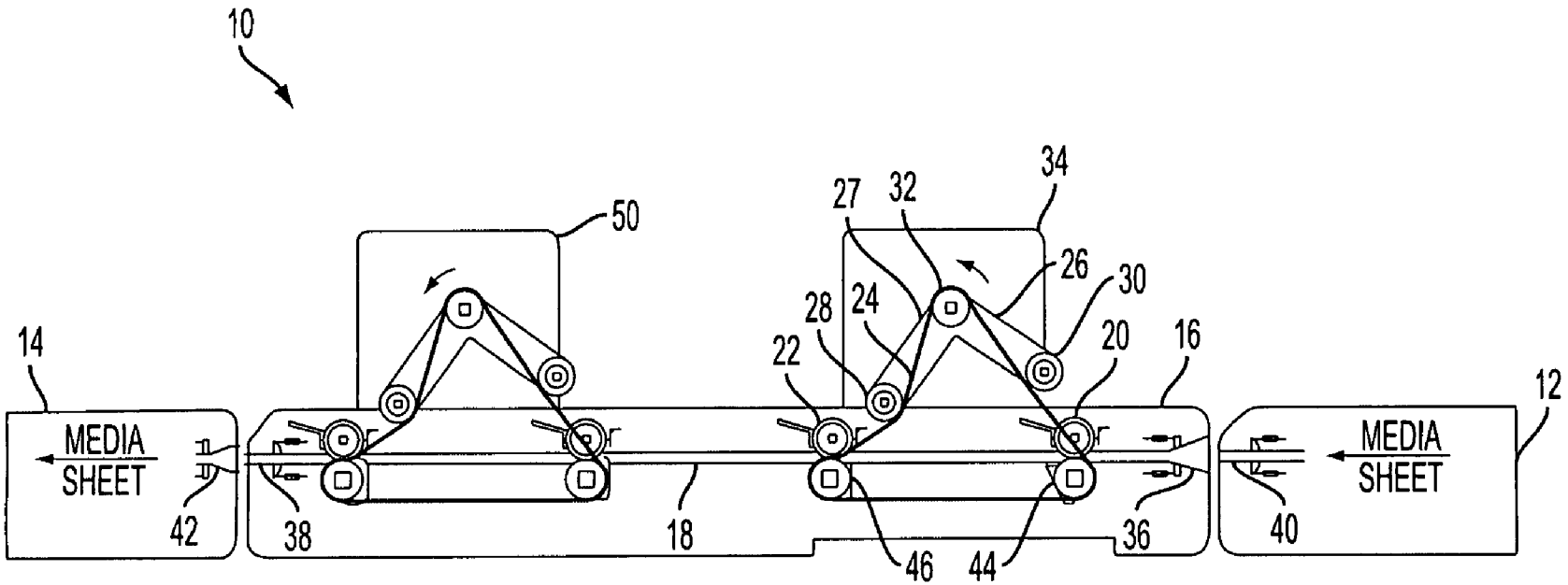
FIGS. 1A and 1B illustrate a media sheet transport according to an exemplary embodiment of this disclosure.
Figure 1B:
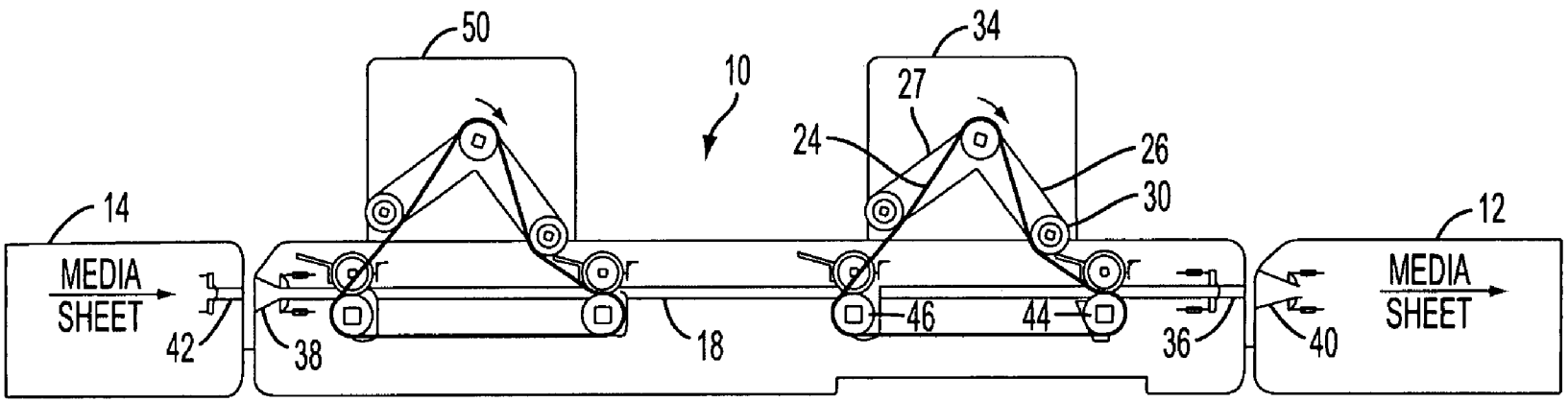

With reference to FIGS. 1A and 1B, illustrated is a bidirectional media sheet transport 10 according to one exemplary embodiment of this disclosure. The bidirectional media sheet transport 10 comprises media sheet input/outputs 12 and 14, and a frame 16 which houses two sets of bidirectional nip assemblies operatively connected to bidirectional motors 34 and 50. For purposes of clarity, the hardware and operation of the bidirectional nip assemblies operatively connected to only motor 34 is described in detail. Notably, the operation of the nip assemblies operatively connected to motor 50 is identical and will not be described separately.

With continuing reference to FIGS. 1A and 1B, the bidirectional media sheet transport 10 further comprises a media sheet path/track 18 and media sheet input/output baffles 36 and 38 which operate in conjunction with media sheet input/output baffles 40 and 42, respectively, to transport media sheets to and from the bidirectional media sheet transport 10.

To facilitate bidirectional travel of a media sheet, nip bottom rollers 44 and 46 are driven by a belt 24 which is driven in a counter clockwise direction or a clockwise direction by the motor 34. In addition to bottom rollers 44 and 46, the nip assemblies include top rollers 20 and 22, where media sheets pass between the top and bottom rollers of the nip assemblies.

To provide proper tensioning of the belt 24 for counter clockwise and clockwise rotation, the transport comprises tensioning arms 26 and 27 which include rollers 28 and 30. The rollers 28 and 30 engage the belt to provide proper tensioning of the belt 24 depending on the direction of rotation. The tensioning arms 26 and 27 are coupled to the motor 34 by a mechanical fastening means at roller 32. Roller 32 engages the belt 24 which drives the nip bottom rollers 44 and 46 to transport a media sheet along the media sheet path/track 18.

In operation, the transport 10 may operate to transport a media sheet from media sheet input/output 12 to media sheet input/output 14 as illustrated in FIG. 1A. Alternatively, the transport 10 may operate to transport a media sheet from media sheet input/output 14 to media sheet input/output 12 as illustrated in FIG. 1B.

With reference to FIG. 1A, a first mode of operation of the bidirectional media sheet transport 10 and operatively connected input/output baffles, 36 and 42, is now described. As previously indicated, the media sheet travels from right to left from the perspective of drawing FIG. 1A.

Initially, a media sheet (not shown) is transported from the media sheet input/output 12 to the transport 10 by means of a controllable baffle arrangement. Specifically, the media sheet input/output baffle 40 is in a relatively closed position while the transport media sheet input/output baffle 36 is in a relatively open position. This configuration provides for routing of the media sheet where the bidirectional media sheet transport 10 and media sheet input/output 12 are not mechanically integrated. To control the positions of the input/output baffles 36 and 40, an actuator and spring arrangement may be used.

After the media sheet is fed into the transport 10 along the media sheet path 18, nip rollers 20 and 44 further advance the media sheet wherein bottom roller 44 rotates in a counter clockwise direction by means of the belt 24. As shown in FIG. 1A, belt tensioning arm 27 rotates in the counter clockwise direction to engage the belt 24 and provide the necessary tensioning to drive bottom rollers 44 and 46. Notably, this configuration enables the motor 34, to simultaneously provide the required torque to tension the belt 24 and drive the nip rollers 44 and 46 by means of a clutch or slip joint coupling means from the motor 34 shaft to the tensioning arm roller 32.

After the media sheet is driven by nip rollers 20, 44, 22 and 46, the media sheet continues to be driven by the nip assemblies associated with motor 50 until the media sheet is ejected from the transport 10 into the media sheet input/output 14 by means of a baffle interface. Notably, the baffle interface includes a transport media sheet input/output 38 baffle in a relatively closed position and a media sheet input/output baffle 42 in a relatively open position.

With reference to FIG. 1B, a second mode of operation of the bidirectional media sheet transport 10 and operatively connected input/output baffles, 36 and 42, is now described. During this mode of operation, a media sheet travels from left to right from the perspective of drawing FIG. 1B.

Initially, a media sheet (not shown) is transported from the media sheet input/output 14 by means of media sheet input/output baffle 42 and transport media sheet input/output baffle 38. Notably, the media sheet input/output baffle 42 is in a relatively closed position and the transport media sheet input/output baffle 38 is in a relatively open position.

From this point the media sheet travels along the media sheet path 18 being driven by the nip rollers associated with motor 50 and 34. Notably, to rotate the bottom drive rollers 46 and 44 in a clockwise direction, the motor 34 rotates clockwise which rotates tension arm 26 to engage roller 30 and the belt 24. The media sheet is driven to the media sheet input/output and ejected from the transport 10 by means of the input/output baffle arrangement which comprises transport media sheet input/output baffle 36 in a relatively closed position and media sheet input/output baffle 40 in a relatively open position.

Notably, the exemplary embodiment illustrated in FIGS. 1A and 1B provides a means for bidirectional rotation of two nip assemblies driven by a common belt. However, this disclosure is not limited to two bidirectional nip assemblies as illustrated. For example, one, three, four, etc., nip assemblies can be simultaneously driven using a common belt and tension arm configuration.

Figure 2:
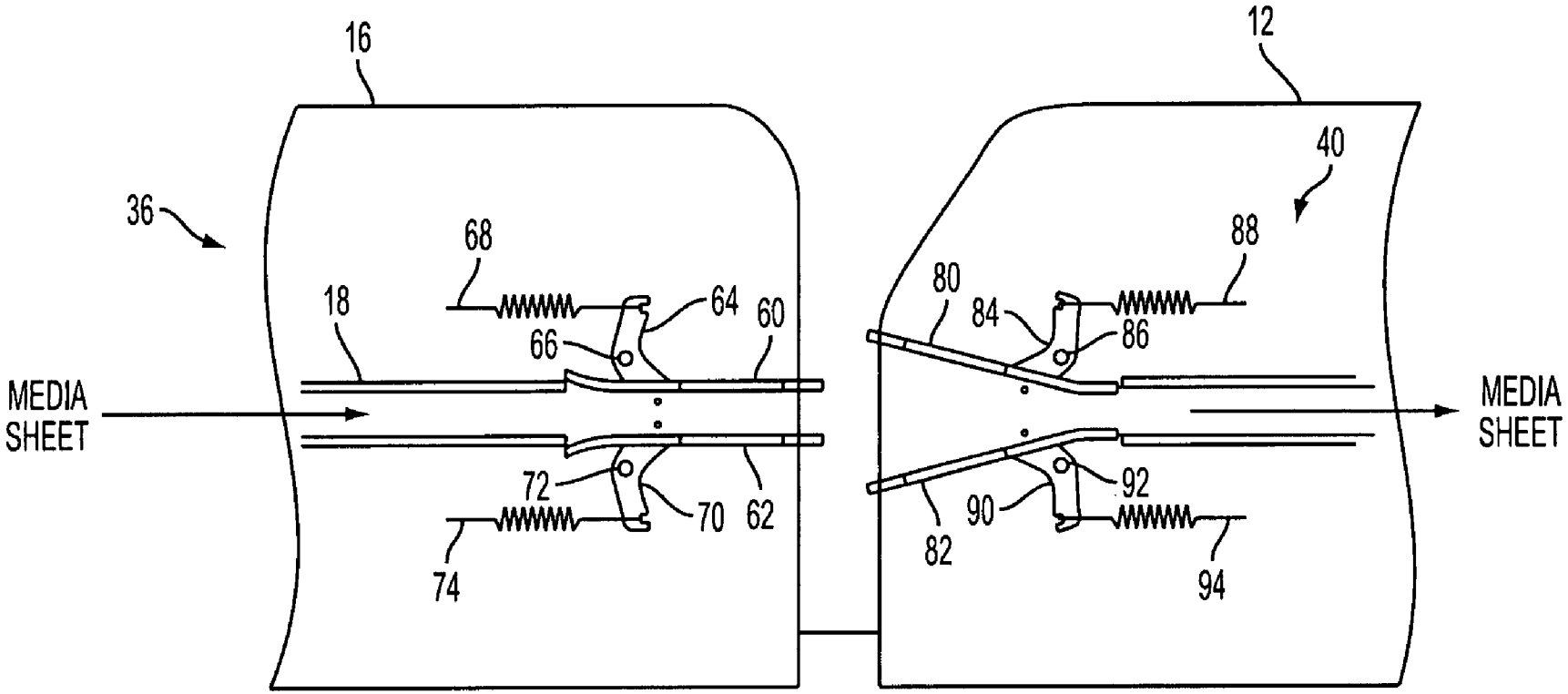
FIG. 2 illustrates a detailed view of the media sheet transport illustrated in FIGS. 1A and 1B.

With reference to FIG. 2, illustrated is a detailed view of a media sheet transport input/output baffle 16 and associated media sheet input/output baffle 12. Notably, the hardware illustrated can be integrated with other printing system modules, for example, a first and a second transport module horizontally aligned, a transport module and a printing module horizontally aligned, etc.

With continuing reference to FIG. 2, the baffles are positioned to guide a media sheet traveling from the left to the right from the perspective of FIG. 2. Initially, a media sheet is guided by media sheet track/guide 18 in the direction indicated. As illustrated, the transport media sheet input/output baffle assembly 36 throat is in a relatively closed position and the media sheet input/output baffle 40 throat is in a relatively open position. Notably, as described in this disclosure, a baffle throat open position is defined as a baffle position where the top and bottom of the baffle are not parallel and opened a predetermined angle. Conversely, the baffle throat closed position is defined as a baffle position where the top and bottom of the baffle are substantially parallel or tapered inward. This arrangement provides an effective means for guiding a media sheet from the transport to the media sheet input/output 12. As previously discussed, the transport media sheet input/output baffle 36 and media sheet input/output baffle 12 are positioned in a relatively open and closed position, respectively, for a media sheet traveling from the media sheet input/output 12 to the transport media sheet input/output 36.

Regarding the transport media sheet input/output baffle 36, this baffle assembly comprises a baffle top member 60 and a baffle bottom member 62. The baffle top member 60 comprises a baffle top member arm 64, a baffle top member pivot point 66 and a spring 68 operatively connected to the baffle top member arm 64. The baffle bottom member 62 comprises a baffle bottom member arm 70, a baffle bottom member pivot point 72 and a spring 74 operatively connected to the baffle bottom member arm 70. In operation, one or more actuators (not shown) such as a solenoid, motor, etc., are mechanically attached to springs 68 and 74. The actuator is controlled to exert the necessary forces to open and close baffle top member 60 and baffle bottom member 62.

Regarding the media sheet input/output baffle 40, this baffle assembly comprises hardware which is similar or identical to the transport media sheet input/output baffle 36. The media sheet input/output baffle 40 comprises a baffle top member 80 and a baffle bottom member 82. The baffle top member 80 comprises a baffle top member arm 84, a baffle top member pivot point 86 and a spring 88. The baffle bottom member 82 comprises a baffle bottom member arm 90, a baffle bottom member pivot point 92 and a spring 94. In operation, one or more actuators (not shown) are mechanically attached to springs 88 and 94. The baffle top member 80 and bottom member 82 open and close as previously discussed with regard to the transport media sheet input/output baffles 36.

Figure 3A:
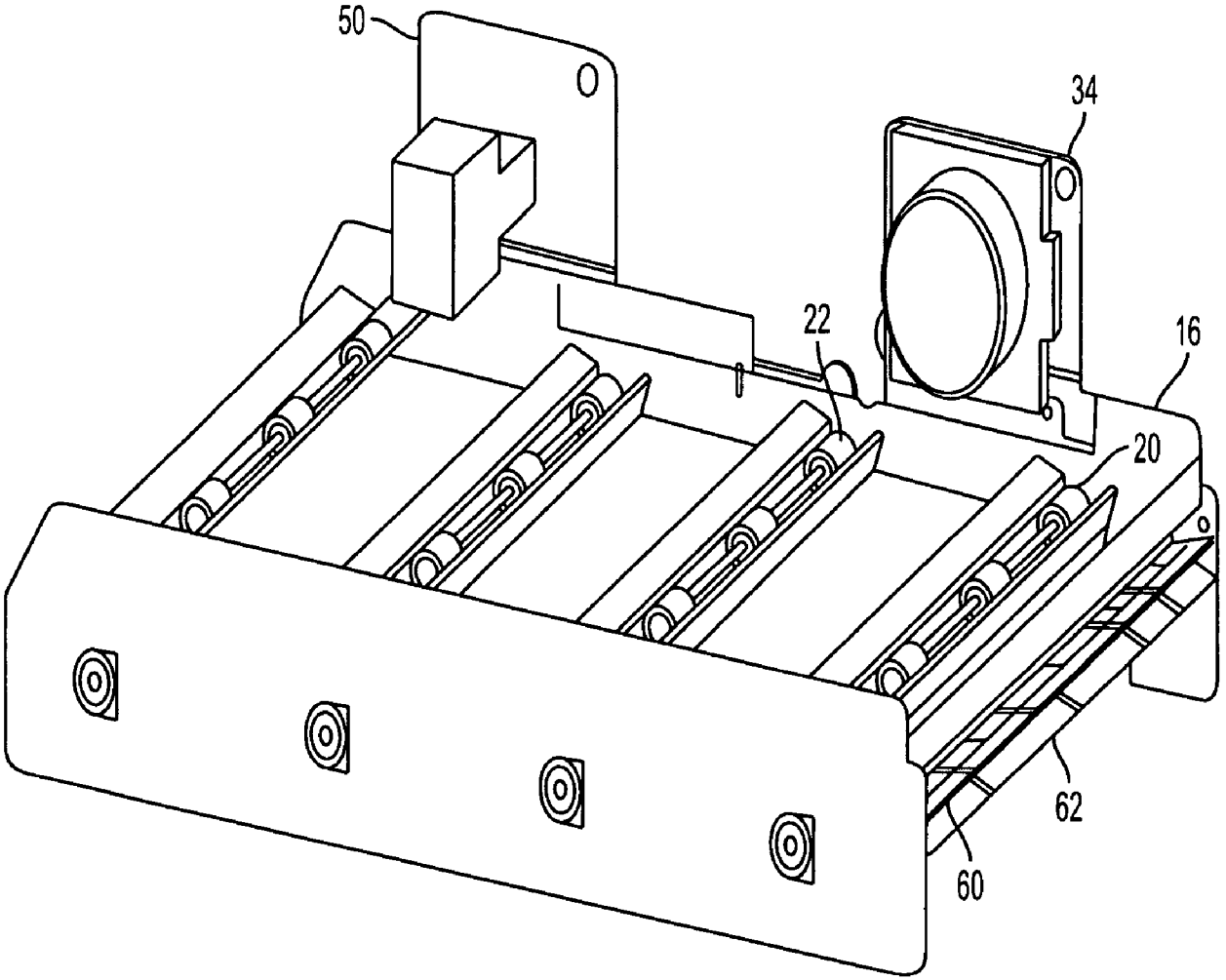
FIGS. 3A and 3B illustrate an exemplary embodiment of a media sheet transport according to this disclosure.
Figure 3B:
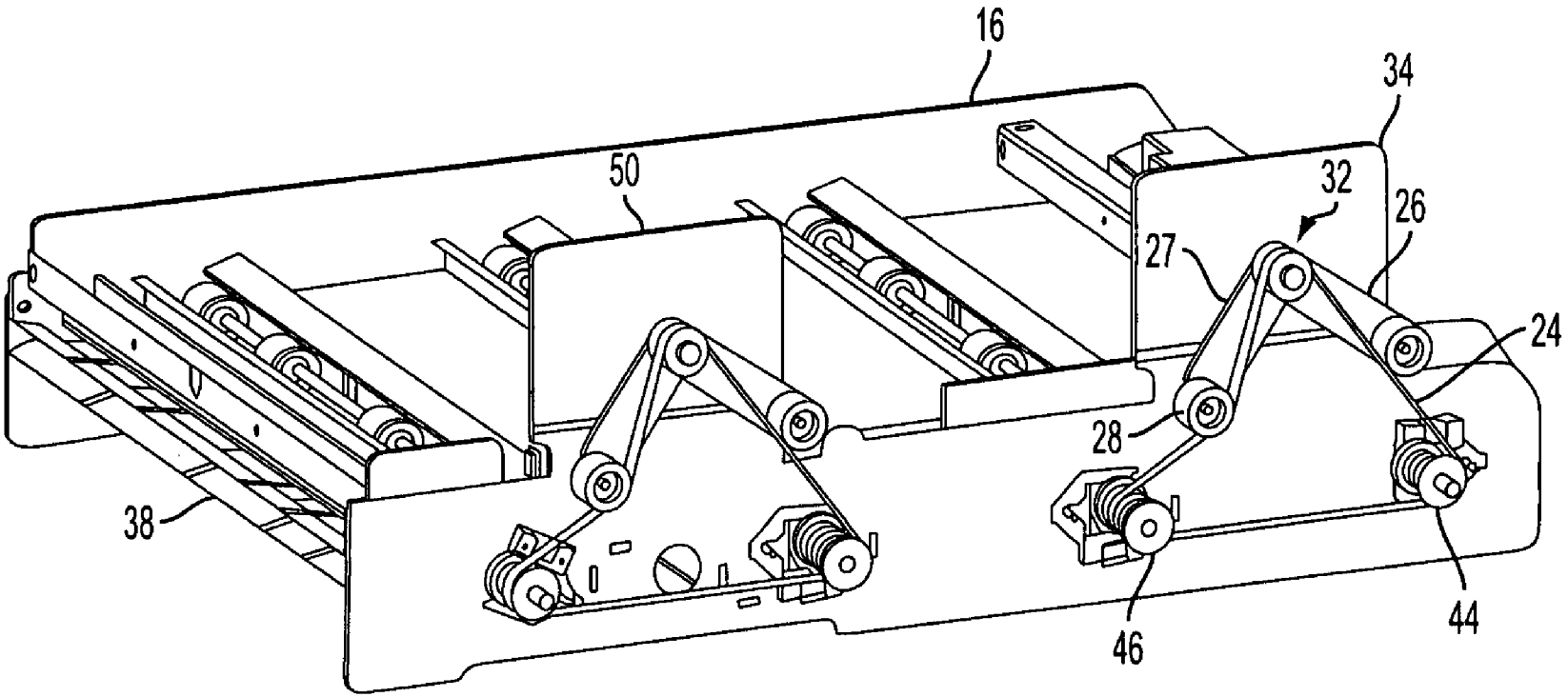

With reference to FIGS. 3A and 3B, illustrated are perspective views of an exemplary embodiment of the bidirectional media sheet transport described heretofore.

Figure 4:
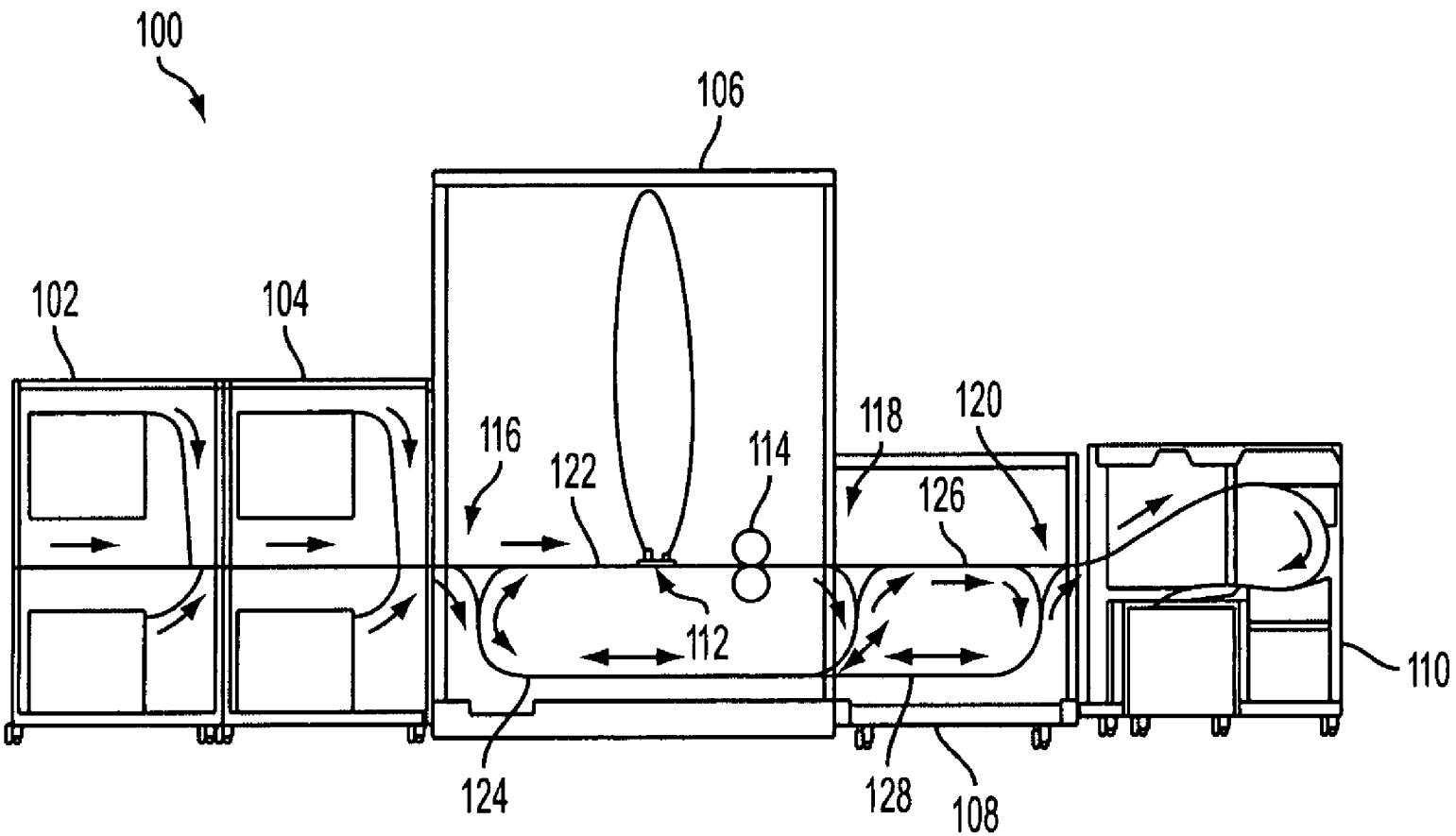
FIG. 4 illustrates a printing system comprising a bidirectional media sheet transport according to an exemplary embodiment of this disclosure.

With reference to FIG. 4, illustrated is a printing system 100 which integrates a bidirectional media sheet transport according to another exemplary embodiment of this disclosure. The printing system 100 comprises media sheet feeder modules 102 and 104, a printing module 106, a bidirectional media sheet transport module 108 and a media sheet finishing module 110.

The printing module 106 comprises an image marking zone 112, a fuser 114, an interface 116 and a bidirectional transport path 124.

The bidirectional media sheet transport module comprises interfaces 118 and 120, a unidirectional transport path 126 and a bidirectional transport path 128.

In operation, the printing system 100 interfaces 116, 118 and 120 provide media sheet inversion functionality to the printing system 100. In addition, the bidirectional capability of transports 124 and 128 enable the printing system to route a media sheet where the image marking zone 112 is bypassed.

Figure 5:
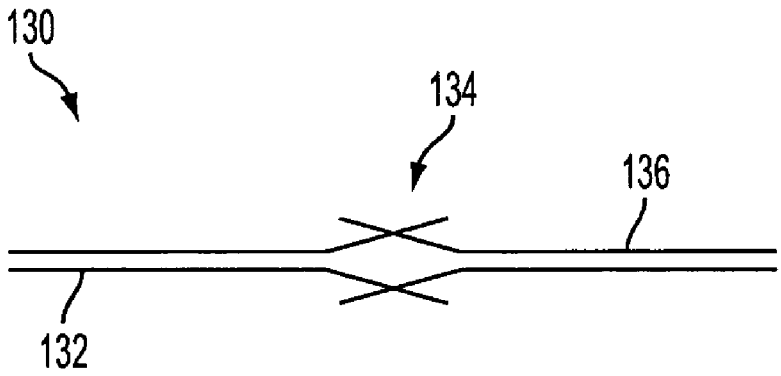
FIG. 5 illustrates a media sheet input/output baffle according to an exemplary embodiment of this disclosure.

With reference to FIG. 5, illustrated is another exemplary embodiment of a media sheet input/output baffle 130 according to this disclosure. This baffle arrangement comprises media sheet paths 132 and 136 operatively connected to an interlaced or interleaved baffle 134. The interlaced baffle 134 is fixed during operation and does not require opening and closing.

Figure 6:
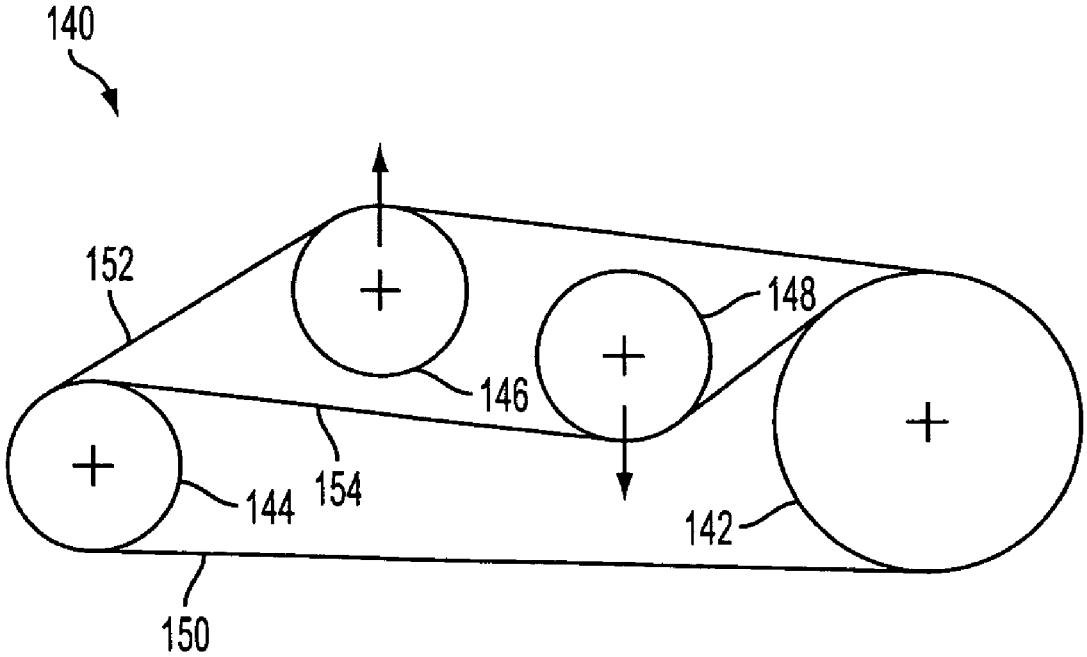
FIG. 6 illustrates a belt tensioning device according to an exemplary embodiment of this disclosure.

With reference to FIG. 6, illustrated is a belt tensioning device 140 according to another exemplary embodiment of this disclosure. This device provides another means of applying belt tension force in two directions in order to drive a nip roller bidirectionally. The belt tensioning device comprises a nip bottom roller 142, a motor shaft 144, an inside idler roller 146, a backside idler roller 148, and a belt 150. In operation, the belt is forced to a first position 152 or a second position 154.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A media sheet transport comprising:

one or more nip assemblies aligned to transport a media sheet along a path;

a motor operatively connected to the one or more nip assemblies; and one or more input/output baffles operatively connected to the one or more nip assemblies, each input/output baffle including an adjustable throat to selectively open and close the adjustable throat during the operation of the media sheet transport to provide a respective entrance and exit for a media sheet, wherein the media sheet transport is adapted to selectively transport a media sheet in a first direction along the path and transport a media sheet in a second direction along the path, wherein the second direction is opposite the first direction.

2. The media sheet transport according to claim 1 further comprising:

a frame adapted to align the one or more nip assemblies.

3. The media sheet transport according to claim 1, further comprising:

a belt operatively connected to the one or more nip assemblies;

a belt tension arm assembly operatively connected to the belt; and a motor shaft operatively connected to the motor and the belt tension arm assembly, wherein the motor drives the shaft, tension arm, belt and nip assemblies.

4. The media sheet transport according to claim 2, wherein the motor rotates in a first direction to transport one or more media sheets in the first direction and the motor rotates in a second direction to transport one or more media sheets in the second direction.

5. The media sheet transport according to claim 3, wherein the belt tension arm assembly exerts a first force on the belt while the motor rotates in a first direction and the tension arm assembly applies a second force on the belt while the motor rotates in a second direction, where the first and second forces are not equivalent vectors.

6. The media sheet transport according to claim 4, the belt tension arm assembly further comprising:

a first belt tension arm operatively connected to the motor shaft; and a second belt tension arm operatively connected to the motor shaft, wherein the first belt tension arm applies the first force on the belt and the second belt tension arm exerts the second force on the belt.

7. The media sheet transport according to claim 5, further comprising:

a clutch operatively connected to the motor shaft and belt tension arm assembly, wherein the clutch controls the first and second forces applied to the belt.

8. The media sheet transport according to claim 6, the media sheet transport comprising:

a first nip assembly comprising one or more nip roller pairs, wherein the nip roller pairs comprise a top roller and a bottom roller, and the bottom roller is operatively connected to be driven by the belt.

9. The media sheet transport according to claim 7, the media sheet transport comprising:

a second nip assembly comprising one or more nip roller pairs, wherein the nip roller pairs comprise a top roller and a bottom roller, and the bottom roller is operatively connected to be driven by the belt.

10. The media sheet transport according to claim 1, the input/output baffles comprising:

a baffle throat closed mode of operation to output a media sheet and a baffle throat open mode of operation to input a media sheet.

11. The media sheet transport according to claim 10, the input/output baffles comprising:

a top baffle member; and a bottom baffle member, wherein the top baffle member and bottom baffle member are substantially parallel during the baffle throat closed mode of operation and the top baffle member and bottom baffle member are opened an angle greater than zero degrees during the baffle throat open mode of operation.

12. The media sheet transport according to claim 11, the input/output baffles comprising:

a first spring operatively connected to the top baffle member; and a second spring operatively connected to the bottom baffle member, wherein the first and second springs are operatively connected to one or more actuators, the one or more actuators providing the necessary force to open and close the input/output baffles.

* * * * *